United States Patent [19]

Naylor et al.

[11] Patent Number: 4,726,180

[45] Date of Patent: Feb. 23, 1988

[54] FALSE TWIST APPARATUS

[75] Inventors: Geoffrey Naylor; Christopher J. Lawrence, both of Macclesfield; Philip M. Wilkinson, Cheadle, all of United Kingdom

[73] Assignee: Rieter Scragg, Cheshire, England

[21] Appl. No.: 36,328

[22] Filed: Apr. 9, 1987

[30] Foreign Application Priority Data

May 7, 1986 [GB] United Kingdom ..... 8611073

[51] Int. Cl.[4] ..... D02G 1/08; D02G 1/02

[52] U.S. Cl. ..... 57/334; 57/284; 57/291; 57/335; 57/348

[58] Field of Search ..... 57/331, 332, 334, 335, 57/337, 341–348, 284, 290, 291

[56] References Cited

U.S. PATENT DOCUMENTS

| | | | |
|---|---|---|---|
| 3,327,461 | 6/1967 | Wyatt | 57/334 X |
| 3,735,575 | 5/1973 | Hattori | 57/334 X |
| 3,831,365 | 8/1974 | Smith | 57/334 |
| 4,112,664 | 9/1978 | Muhlegg | 57/334 X |
| 4,204,394 | 5/1980 | Luthi | 57/334 |

FOREIGN PATENT DOCUMENTS

| | | |
|---|---|---|
| 1231156 | 5/1971 | United Kingdom . |
| 1267893 | 3/1972 | United Kingdom . |
| 1280470 | 7/1972 | United Kingdom . |
| 1353237 | 5/1974 | United Kingdom . |
| 1535870 | 12/1978 | United Kingdom . |

*Primary Examiner*—John Petrakes

*Attorney, Agent, or Firm*—Oblon, Fisher, Spivak, McClelland & Maier

[57] ABSTRACT

A false twist apparatus, for processing primarily fine denier yarns at low level twist levels with consistency and good process control, comprises a roller mounted for rotation about its longitudinal axis and input and output guides, to guide the yarn in a helical path around the roller, mounted on a guide support extending adjacent the roller. One of the guides is positionally adjustable on the support in a direction parallel with the roller axis to alter the helix angle of the yarn around the roller and the twist level. For S and Z twist, two drive spindles are provided symmetrically disposed on opposed sides of the support, the roller being secured on the appropriate spindle and the output guide being moved to the appropriate side of the support.

17 Claims, 5 Drawing Figures

FALSE TWIST APPARATUS

FIELD OF THE INVENTION

This invention relates to false twist apparatus for inserting a false twist in a running textile yarn, and primarily to apparatus for use in the production of so-called torque or stretch yarns, e.g., for hosiery.

BACKGROUND OF THE INVENTION

For many years yarns have been false twisted in order to impart various degrees of bulk and stretch properties to man-made yarns. As the speeds of machines have increased, there has been a move away from the pin twist units previously used towards friction twisting, which can insert high levels of twist at high yarn throughput speeds. However, despite the many improvements which have been made in the design of friction twist units, particularly in relation to the three disc stack type of false twist unit which is now in very common use, the current friction false twist devices are not entirely satisfactory as regards the processing of fine denier yarns at low twist levels such as are required for torque yarns as used in the manufacture of sheer hosiery. Consequently, many hosiery yarn producers still make use of pin twisters with the inherent relatively low throughput speed limitations.

Alternatively, some producers use a lower than normal temperature of the yarn heater when using a friction disc false twist unit so that not all of the high twist inserted by the friction disc unit is set in the yarn. Although this method counters the high twist level, the resulting product is limited in its applications, and process flexibility, product stability and appearance are poor.

It is known to false twist a running yarn by passing it around the surface of a roller in a helical path extending around and along the cylindrical surface thereof. The roller may be driven or may be freely rotatable so as to rotate due to the passage of the yarn therearound. False twist apparatus of this type is decribed in each of British Pat. Nos. 1280470, 1231156 and 1185684.

In the arrangement described in British Pat. No. 1280470, the roller is driven by the yarn, and the level of twist inserted in the yarn by the roller is governed by the friction characteristics of the twist inserting part of the roller and the relative speed of the yarn and the surface of that part of the roller. This latter relationship is dependent on the relative diameters of the twist inserting part of the roller and the drive receiving part around which the yarn travels in a circumferential path and not a helical path. Consequently, if differing twist levels are required for differing yarns, it is necessary to change rollers, so that a stock of rollers of differing configurations is required for each processing station of each machine.

In the case of the apparatus described in British Pat. Nos. 1231156 or 1185684, the change in the level of twist inserted in the yarn can be altered by adjustment of the angle of inclination of the roller to the general forwarding direction of the yarn path in the region of the roller.

In the case of the apparatus of British Pat. No. 1231156, the rollers are freely rotatable and each roller is mounted on a spindle which includes an adjustable knuckle joint as well as an adjustable mounting. As a consequence, it is difficult to arrange that all of the rollers in a multi-station textile machine, and from one machine to another, are set at precisely the same angle to the yarn path to ensure uniformity of processing of the yarns. Also it is a time consuming operation to set all of these rollers.

In the case of the apparatus of British Pat. No. 1185684, the inclination of the roller to the yarn path may again be adjustable in the case that the roller is freely rotatable, with the attendant disadvantages referred to in relation to the apparatus of British Pat. No. 1231156. In addition, the driving of the roller by the yarn introduces variable twisting characteristics along the length of the yarn and from yarn to yarn at each processing station of one or more textile machines. More importantly, damage to the yarn or frequent yarn breakages may be caused, particularly with fine denier yarns, by transmission of the driving force for the roller from the yarn to the roller. Alternatively, however, the roller may be positively driven by the machine drive means, and this leads to additional complications if the roller inclination is to be adjusted. To counteract this problem, it is proposed that the guide upstream of the roller is movable transversely of the roller axis so as to alter the approach angle of the yarn to the roller. However, this deflects the yarn from its natural yarn path from the heater to the roller, and this can cause irregular twist insertion and damage to the yarn in its heated state as it is deflected around the yarn guide.

OBJECT OF THE INVENTION

It is an object of the present invention to provide false twist apparatus which avoids or substantially alleviates the aforementioned disadvantages, and which will enable yarns to be processed at low twist levels with consistency and good process control, primarily fine denier yarns.

SUMMARY OF THE INVENTION

The invention provides a false twist apparatus comprising a roller mounted for rotation about a longitudinal axis thereof, and a guide assembly extending adjacent said roller, said guide assembly comprising input and output yarn guides mounted on a guide support and disposed to guide a yarn in a helical path around said roller, at least one of said guides being positionally adjustable on said guide support in a direction substantially parallel with said axis. Preferably the apparatus also comprises drive means for the roller. Preferably also the output guide is positionally adjustable on said guide support.

The roller may be driven at a surface speed which is in the range 0.4 to 1.0 of the speed of travel of the yarn through the apparatus, preferably between 0.65 and 0.95 of such throughput speed. The roller may be removably mounted on a driving spindle, and the apparatus may comprise a pair of driving spindles disposed symmetrically on opposed sides of said guide support, whereby yarn may be guided around a roller on one of said spindles to give an S-twist in said yarn, and around a roller on the other of said spindles to give a Z-twist in said yarn. The input guide may be mounted symmetrically relative to said spindles and said opposed sides of said guide support. The output guide may comprise a guide roller, which may be located in any one of a plurality of locations provided on each of said opposed sides of said guide support.

The invention may also provide a textile machine comprising a false twist apparatus as aforesaid and means defining a yarn path from heating and cooling zones to said false twist apparatus, wherein said yarn path is inclined to the axis of said roller at an angle substantially equal to the helix angle of the yarn around said roller. The machine may also comprise means providing a supply of yarn and means operable to withdraw yarn from said yarn supply in a clockwise direction or an anti-clockwise direction when a Z-twist or an S-twist respectively is inserted in said yarn by said false twist apparatus.

BRIEF DESCRIPTION OF THE DRAWINGS

Embodiments of false twist apparatus in accordance with the invention will now be described with reference to the accompanying drawings in which.

DETAILED DESCRIPTION OF THE PRESENTLY PREFERRED EMBODIMENTS

Figure 1:
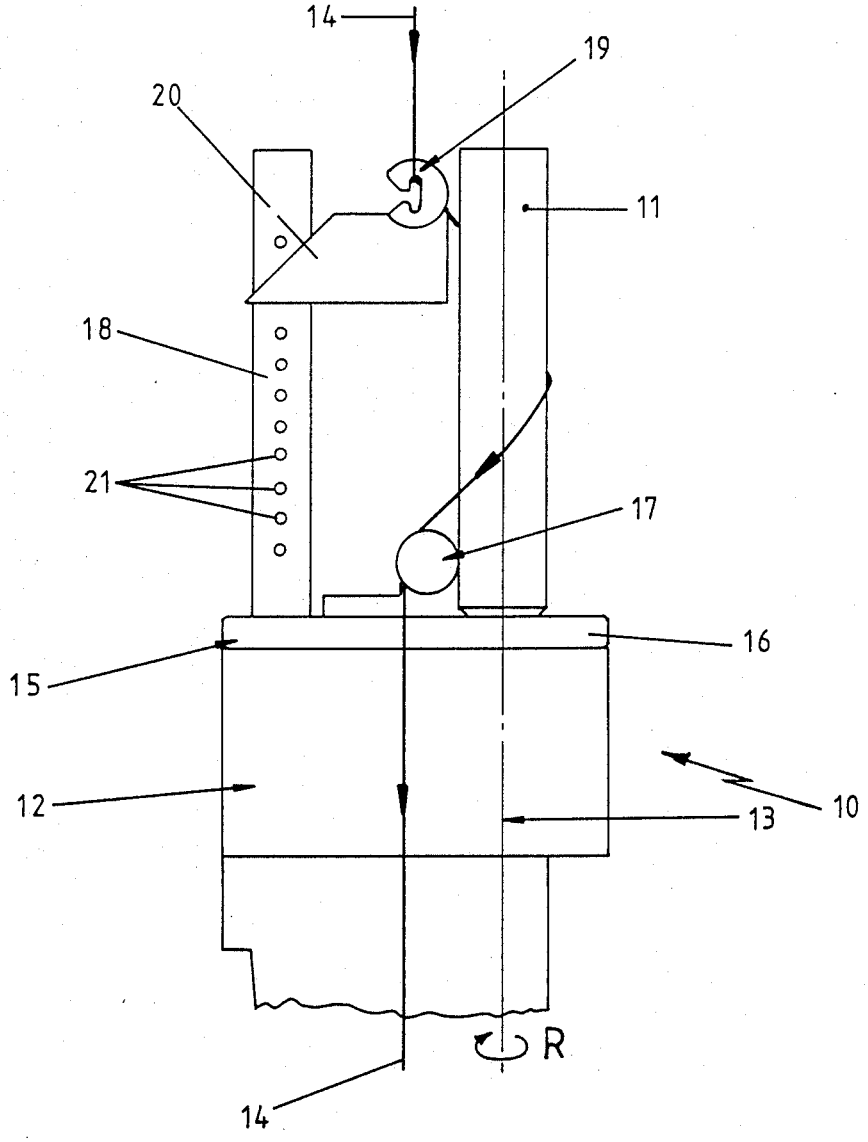
FIG. 1 is an elevation of a first embodiment.

Referring now to FIG. 1, there is shown a false twist apparatus 10 comprising a roller 11 mounted in a textile machine 12 for rotation about a substantially vertically arranged longitudinal axis 13 of the roller 11. The roller 11 may be freely rotatable so as to be driven by the passage of a yarn 14 therearound, but preferably it is driven by drive means (not shown) in a direction as shown by arrow R so as to forward as well as twist the yarn 14.

Adjacent the roller 11 is a guide assembly 15 comprising a bottom plate 16 to which an output guide 17 is fixed and from which a guide mounting post 18 extends in a direction parallel with longitudinal axis 13 of the roller 11. An input guide 19 is mounted on the guide mounting post 18, and it is positionally adjustable longitudinally thereof, i.e., in a direction parallel with the longitudinally axis 13 of the roller 11. Such adjustment is effectd by locating a mounting 20 for the input guide 19 in a selected one of a plurality of indents or apertures 21 provided in the guide mounting post 18. The guides 17, 19 are positioned substantially in a plane containing the longitudinal axis 13 of the roller 11 so that the yarn 14 makes approximately one turn about the roller 11, contacting the roller 11 through a substantially constant angle of wrap of approximately 180°, for all positions of adjustment of the input guide 19. Consequently, the helix angle of the yarn path around the roller 11 is directly related to the axial position of the input guide 19 relative to the output guide 17. The indents or apertures 21 may be calibrated accordingly with the appropriate helix angles. Since the level of twist imparted to the yarn 14 is directly related to the helix angle of the yarn 14 on the roller 11, adjustment of the apparatus 10 to provide a given twist level is readily accomplished. In addition, the yarn path through the textile machine outside of the region between the guides 17, 19 is substantially unaffected by the postional adjustment of the input guide 19, giving consistency of processing for differing yarns.

Figure 2:
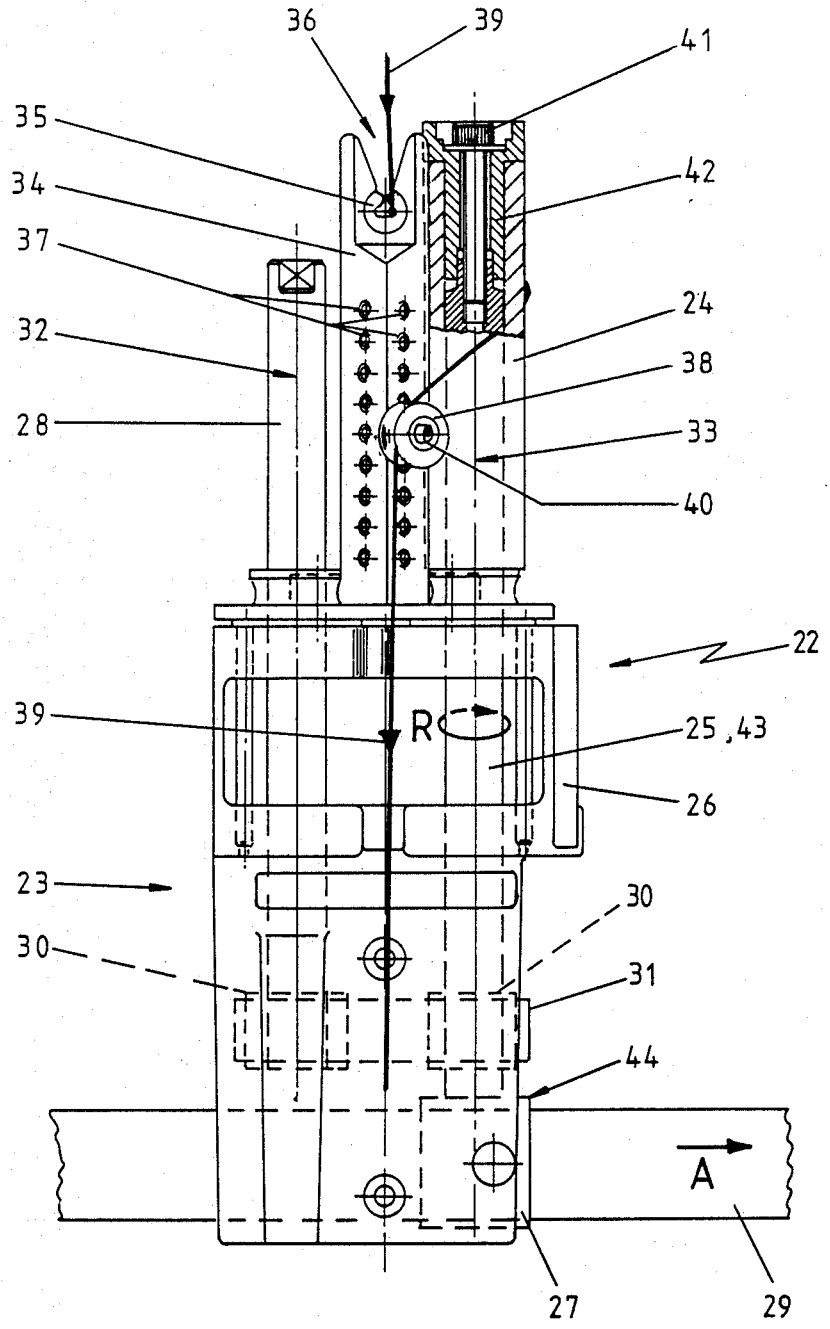
FIG. 2 is an elevation of a second embodiment in an 'S' twist configuration
Figure 3:
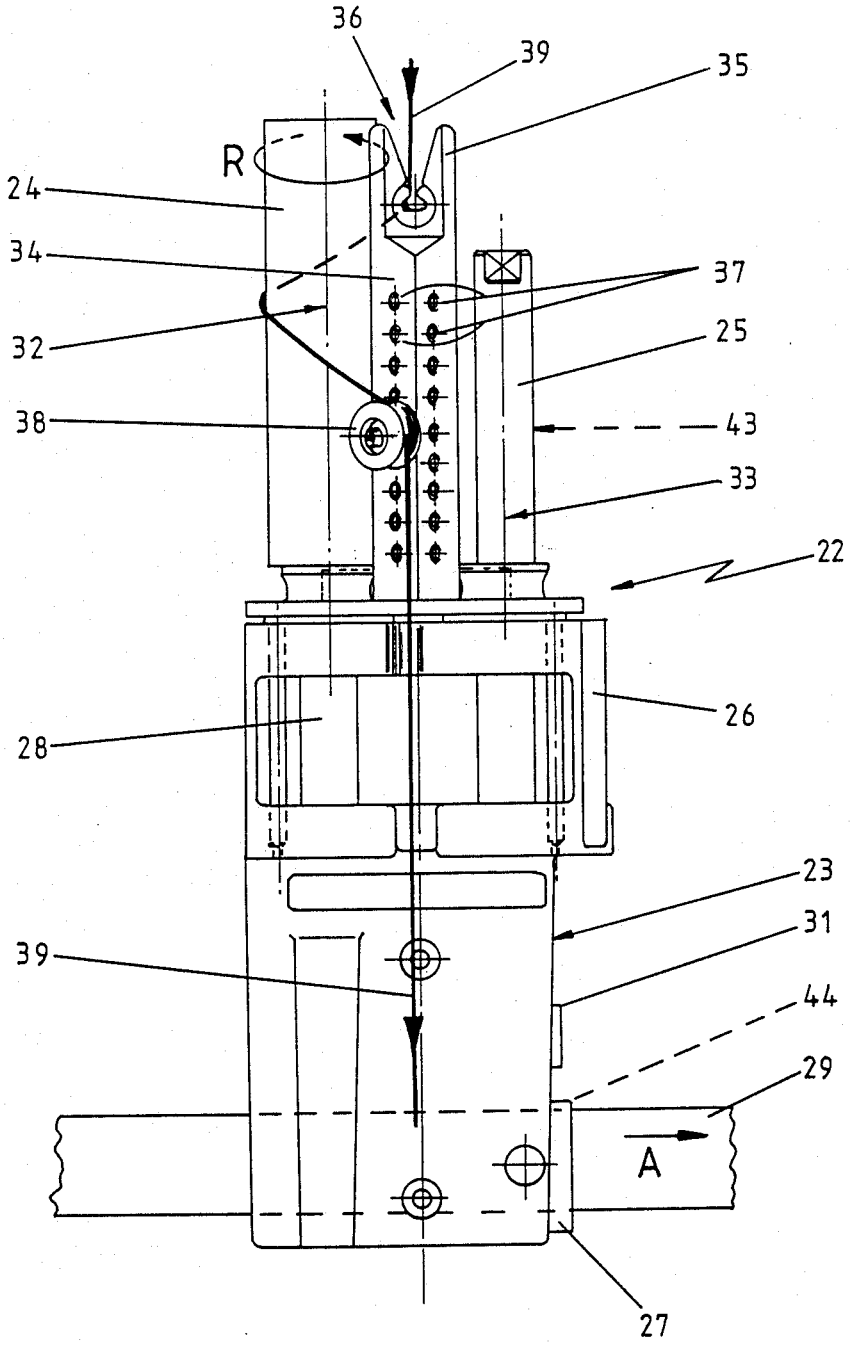
FIG. 3 is an elevation of the embodiment of FIG. 2 in a 'Z' twist configuration.

Referring now to FIGS. 2 and 3, there is shown a false twist apparatus 22 mounted in a textile machine 23. The apparatus 22 comprises a roller 24 mounted on a vertically disposed first spindle 25 having a longitudinal axis 33 as shown in FIG. 2. The first spindle 25 is mounted in bearings (not shown) in a housing 26 and has wharve 27 at the end remote from the roller 24. The apparatus 22 also comprises a second spindle 28 which is adapted to receive the roller 24 thereon, as shown in FIG. 3, and which has a longitudinal axis 32. A third, or slave, spindle 43 (FIG. 4) is in alignment with and shielded by the first spindle 25 in FIGS. 2 and 3. The slave spindle 43 also has a wharve 44 on the lower end thereof, and a drive belt 29 passes between the wharve 44 and the wharve 27 on the first spindle 25. The two roller receiving spindles 25, 28 and the slave spindle 43 have toothed pulleys 30 thereon around which a toothed belt 31 passes, as shown in FIG. 2, so that the spindles 25, 28 and the slave spindle 43 rotate at the same speed in the same direction when viewed in plan.

The apparatus 22 can be positionally adjusted forwardly and rearwardly in the machine 23, ar alternatively by pivoting about the longitudinal axis 32 of the second spindle 28, so that the wharve 27 or the wharve 44 on the slave shaft 43 can contact the drive belt 29. With the roller 24 on the first spindle 25 and the wharve 27 in contact with the drive belt 29 travelling in the direction of the arrow A, the roller 24 will be driven in a clockwise direction when viewed in plan, as shown by arrow R in FIG. 2. With the roller 24 on the second spindle 28 and the wharve 44 on the slave spindle 43 in contact with the drive belt 29 travelling in the direction of arrow A, the roller 24 will be driven in an anti-clockwise direction when viewed in plan, as shown by arrow R in FIG. 3. With such an arrangement, each individual false twist apparatus 22 in a multi-station textile machine 23 can be driven in either direction using a single common drive belt 29, the direction of rotation and the positioning of guides 35, 38 for a yarn 39 being chosen as described below so that the rotation of the roller 24 tends to forward the yarn 39 as well as to twist it.

Mounted on the housing 26, and equi-spaced from the longitudinal axes 32, 33 of the spindles 28, 25 respectively, is a guide support or mounting post 34. Mounted on top of the guide mounting post 34 is a fixed input guide 35, having an upwardly facing threading opening 36 therein. The guide mounting post 34 has two rows of indents or apertures 37 into an appropriate one of which indents or apertures 37 an output guide 38 may be located by means of a screw 40. With the roller 24 on the first spindle 25, the wharve 27 in contact with the drive belt 29, and the output guide 38 in an appropriate one of the right hand row of indents or apertures 37, the yarn 39 will be given an 'S' false twist. By means of the apparatus of the invention, it is a simple matter to change the hand of twist given to the yarn 39 without reversing the direction of travel of the drive belt 29. In this case the roller 24 is transferred to the second spindle 28 from the first spindle 25, the output guide 38 is located in an appropriate one of the left hand row of indents or apertures 37 as shown in FIG. 3, and the apparatus 22 is displaced forwardly so that the wharve 44 on the slave spindle 43 contacts the drive belt 29 instead of the wharve 27. These adjustments are effected simply and quickly, that of the roller 24 being effected by removal of a roller retaining screw 41 which secures the roller 24 on the first spindle 25, together with a drive transmitting cap 42. The roller 24 and the cap 42 are then placed on the second spindle 28 and secured thereon by the retaining screw 41. It is to be noted that the apparatus 22 is substantially symmetrical about the path of the yarn 39 to and from the apparatus 22 so that little if any change in that yarn path occurs when the helix angle of the yarn 39 around the roller 24 and the hand of the apparatus 22 is changed. Consequently, consistency of processing the yarn 39 for all adjustments of the apparatus 22, and from apparatus to apparatus, is achieved.

Figure 4:
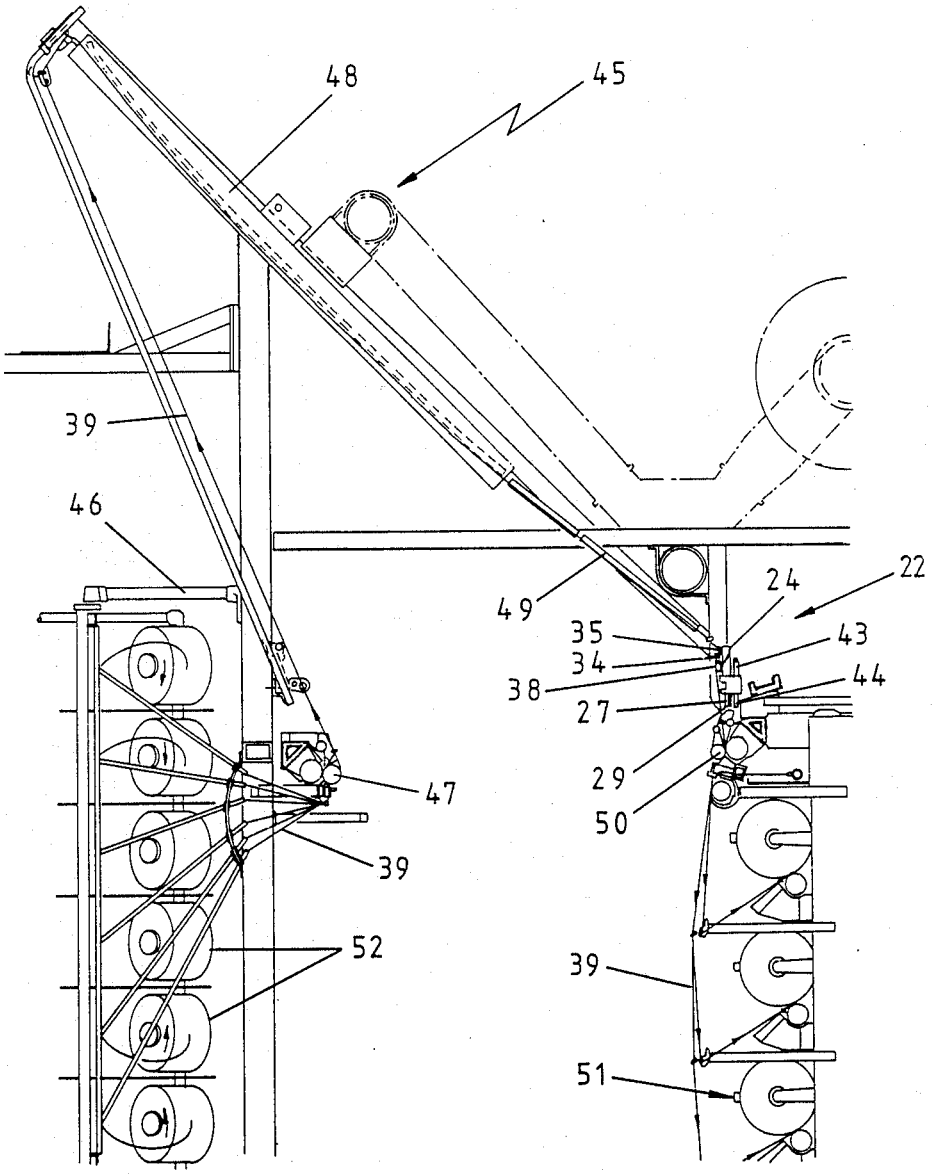
FIG. 4 is a schematic drawing of a textile machine incorporating the false twist apparatus of the invention.

Referring now to FIG. 4 there is shown a textile machine 45 comprising a creel 46, a first feed means 47, a primary heater 48, defining a heating zone, a cooling plate 49 defining a cooling zone, a false twist apparatus 22 of the type described in relation to FIGS. 2 and 3, a second feed means 50, and wind-up means 51. Such a machine may also comprise a second heater and third feed means (not shown ) between the second feed means 50 and the wind-up means 51 if desired. The inclination of the primary heater 48 and the cooling plate 49 to the axis of the roller 24 is substantially equal to the helix angle of the yarn 39 around the roller 24 so that the yarn path is substantially straight through the heating and cooling zones and the angle of wrap over the surface of the input guide 35 is kept to a minimum. This ensures that the low twist level inserted in the yarn 39 by the false twist apparatus 22 runs uniformly back through the cooling zone to the heating zone.

Mounted in the creel 46 are a plurality of supply packages 52 of yarn 39, the first feed means 47 being operable to withdraw the yarn 39 from the packages 52. With the false twist apparatus 22 set to insert an S-twist in the yarn 39 as shown in FIGS. 2 and 4, the first feed means 47 withdraws the yarn 39 from the packages 52 in an anti-clockwise direction as shown at the lower packages 52 in FIG. 4. If, however, the apparatus 22 is set to insert a Z-twist in the yarn 39 as shown in FIG. 3, then the first feed means 47 withdraws the yarn 39 from the packages 52 in a clockwise direction as shown at the upper packages 52 in FIG. 4. This ensures that the torque and low twist levels generated by the apparatus 22 are more regular than would be the case if the correct unwinding direction was not followed, particularly in the case of multi-filament yarns.

Figure 5:
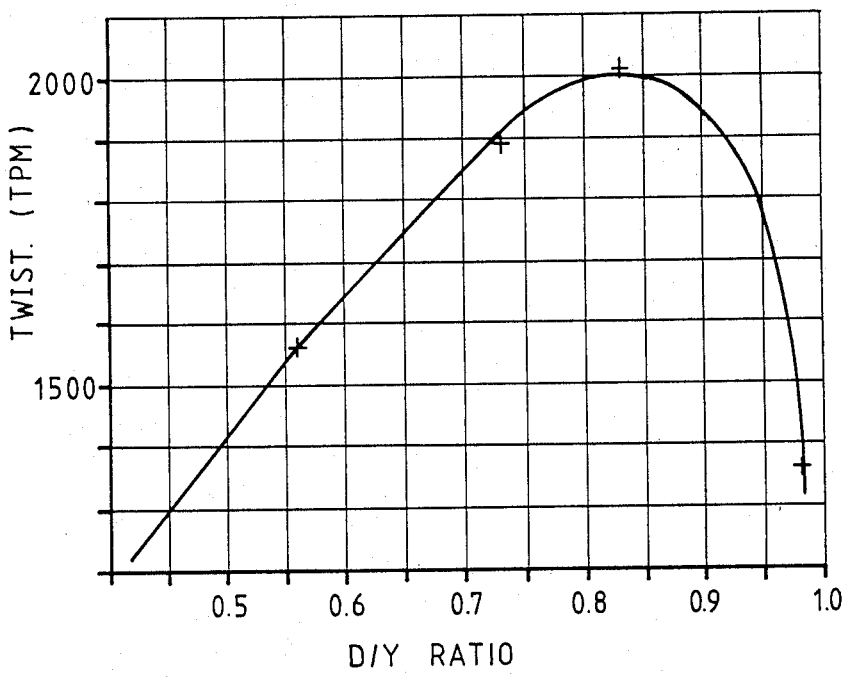
FIG. 5 is a graph of twist level against the ratio of roller surface speed to yarn forwarding speed.

Referring now to FIG. 5 there is shown a graph of twist level imparted to the yarn by the apparatus of the invention against the ratio of roller surface speed to yarn throughput speed as defined by the surface speed of the second feed means 50 (D/Y ratio). This shows that the twist level is greatest at a D/Y ratio of approximately 0.83 and falls off rapidly outside the range 0.4 to 1.0. In consequence, the preferred range of D/Y ratio for operation of the apparatus is 0.65 to 0.95.

Other embodiments of false twist apparatus in accordance with the present invention will be readily apparent to persons skilled in the art. For example, although the rollers 11, 24 shown in the figures are right circular cylinders, other forms of roller may be used if desired, such as a frusto-conical roller, or a diabolo roller which reduces and then increases in a diameter along its length. Such shaped cylinders can reduce the tendency of the yarn to adopt a circumfential rather than a helical path around the roller over the first and last parts of its travel around the surface of the roller.

We claim:

1. A false twist apparatus comprising:

(a) a roller having a longitudinal axis and mounted for rotation about said longitudinal axis and (b) a guide assembly extending adjacent said roller and disposed to guide a yarn in a helical path around said roller, said guide assembly comprising a guide support and means for adjusting the helix angle of said helical path, said means for adjusting the helix angle of said helical path comprising input and output yarn guides mounted on said guide support, at least one of said input and output yarn guides being positionally adjustable on said guide support in a direction substantially parallel with said longitudinal axis.

2. False twist apparatus according to claim 1 wherein said output yarn guide is positionally adjustable on said guide support.

3. False twist apparatus according to claim 1 and further comprising drive means for said roller.

4. False twist apparatus according to claim 3 wherein said roller is driven at a surface speed which is in the range 0.4 to 1.0 of the speed of travel of the yarn through said apparatus.

5. False twist apparatus according to claim 4 wherein said roller is driven at a surface speed which is in the range 0.65 to 0.95 of the speed of travel of the yarn through said apparatus.

6. False twist apparatus according to claim 3 wherein:

(a) said drive means comprises at least one driving spindle and (b) said roller is removably mounted on said driving spindle.

7. False twist apparatus according to claim 6 wherein said drive means comprises a pair of driving spindles disposed symmetrically on opposed sides of said guide suport.

8. False twist apparatus according to claim 7 wherein:

(a) one of said pair of driving spindles has a wharve thereon and (b) said false twist apparatus further comprises a drive belt for contact with said wharve to drive it in rotation.

9. False twist apparatus according to claim 8 wherein said pair of driving spindles are drivingly connected to each other so as to rotate in the same direction at the same speed.

10. False twist apparatus according to claim 9 and further comprising a supportive structure and a slave spindle having a wharve thereon, said slave spindle being drivingly connected to said pair of driving spindles so as to rotate in the same direction and at the same speed as said pair of driving spindles, said drive belt passing between said wharves and said spindles being movably mounted on said supportive structure, whereby either one of said wharves is in contact with and driven by said drive belt.

11. False twist apparatus according to claim 7 wherein said input yarn guide is mounted symmetrically relative to said pair of driving spindles and said opposed sides of said guide support.

12. False twist apparatus according to claim 11 wherein said output yarn guide comprises a roller.

13. False twist apparatus according to claim 11 wherein:

(a) a plurality of locations are provided on each of said opposed sides of said guide support and (b) said output guide is locatable in any one of said plurality of locations.

14. False twist apparatus according to claim 1 wherein said input and output yarn guides are positioned substantially in a plane containing the longitudinal axis of said roller, whereby said yarn makes substantially one turn about said roller for all positions of adjustment of said at least one of said input and output yarn guides.

15. A textile machine comprising a false twist apparatus according to claim 1, heating and cooling zones, and means defining a yarn path from said heating and cooling zones to said false twist apparatus, wherein said yarn path is inclined to the axis of said roller at an angle substantially equal to the helix angle of the yarn around said roller.

16. A textile machine according to claim 15 and further comprising a yarn heater and a yarn cooling means, wherein said yarn heater and said yarn cooling means define a substantially straight yarn path through said heating and cooling zones and from said heating and cooling zones to said false twist apparatus.

17. A textile machine according to claim 15 and further comprising:

(a) means for providing a supply yarn and (b) means for withdrawing yarn from said means for providing a yarn supply in a clockwise direction when a Z-twist or an anti-clockwise direction when an S-Twist is to be inserted in said yarn by said false twist apparatus.

* * * * *